US010102821B2

(12) United States Patent
Cho et al.

(10) Patent No.: US 10,102,821 B2
(45) Date of Patent: Oct. 16, 2018

(54) IMAGE PROCESSING DEVICE AND IMAGE PROCESSING METHOD

(71) Applicant: SAMSUNG DISPLAY CO., LTD., Yongin-si, Gyeonggi-Do (KR)

(72) Inventors: Hyun Min Cho, Yongin-si (KR); Jae Byung Park, Yongin-si (KR); Jae Woong Kang, Yongin-si (KR); Jong Hyuk Kang, Yongin-si (KR); Hyun Deok Im, Yongin-si (KR); Sung Jin Hong, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 50 days.

(21) Appl. No.: 15/092,320

(22) Filed: Apr. 6, 2016

(65) Prior Publication Data

US 2016/0379594 A1 Dec. 29, 2016

(30) Foreign Application Priority Data

Jun. 26, 2015 (KR) ..... 10-2015-0091325

(51) Int. Cl.
*G09G 5/02* (2006.01)
*G09G 5/06* (2006.01)
*G09G 5/04* (2006.01)

(52) U.S. Cl.
CPC ..... *G09G 5/06* (2013.01); *G09G 5/04* (2013.01); *G09G 2320/0276* (2013.01); *G09G 2320/0673* (2013.01); *G09G 2320/0693* (2013.01)

(58) Field of Classification Search
None
See application file for complete search history.

(56) References Cited

U.S. PATENT DOCUMENTS 8,823,618 B2 9/2014 Lee et al.
2003/0128299 A1* 7/2003 Coleman ..... G09G 5/10 348/674
2005/0253827 A1* 11/2005 Hung ..... G09G 5/003 345/204

(Continued)

FOREIGN PATENT DOCUMENTS

KR 1020080033651 4/2008
KR 1020080045387 5/2008
KR 1020080050699 6/2008

OTHER PUBLICATIONS

International Telecommunication Union, "Parameter Values for the HDTV Standards for Production and International Programme Exchange," Recommentation ITU-R BT.709-.5 (Apr. 2002).

(Continued)

*Primary Examiner* — Frank Chen
(74) *Attorney, Agent, or Firm* — F. Chau & Associates, LLC.

(57) ABSTRACT

An image processing device includes a first look-up table in which first gamma correction values corresponding to a white grayscale are recorded; a second look-up table in which second gamma correction values corresponding to red, green, and blue grayscales are recorded; and a data correcting unit that calculates second image data from received first image data based on a first gamma correction value and a second gamma correction value for the first image data, by referring to the first and second look-up tables.

15 Claims, 11 Drawing Sheets

(56) References Cited

U.S. PATENT DOCUMENTS

| | | | | |
|---|---|---|---|---|
| 2010/0020094 | A1* | 1/2010 | Park | G09G 3/2055<br>345/589 |
| 2011/0148910 | A1* | 6/2011 | Botzas | G09G 5/02<br>345/600 |
| 2013/0249955 | A1* | 9/2013 | Kim | G09G 3/3233<br>345/690 |
| 2015/0130827 | A1* | 5/2015 | Mizushiro | H04N 9/3182<br>345/589 |

OTHER PUBLICATIONS

[Article] Jae Won Jeong, et al., "Optimization of LCD Color Performance Using a New ACC Technique," SID 2007.
[Article] Seung Woo Lee, et al., "Driving Scheme for Improving Color Performance of LCD'S: Accurate Color Capture," SID 2003.

* cited by examiner

FIG. 2A

| Gray | Red | Green | Blue |
|---|---|---|---|
| 0 | $R_{c,i=0}$ | $G_{c,i=0}$ | $B_{c,i=0}$ |
| 1 | $R_{c,i=1}$ | $G_{c,i=1}$ | $B_{c,i=1}$ |
| 2 | $R_{c,i=2}$ | $G_{c,i=2}$ | $B_{c,i=2}$ |
| 3 | $R_{c,i=3}$ | $G_{c,i=3}$ | $B_{c,i=3}$ |
| 4 | $R_{c,i=4}$ | $G_{c,i=4}$ | $B_{c,i=4}$ |
| 253 | $R_{c,i=253}$ | $G_{c,i=253}$ | $B_{c,i=253}$ |
| 254 | $R_{c,i=254}$ | $G_{c,i=254}$ | $B_{c,i=254}$ |
| 255 | $R_{c,i=255}$ | $G_{c,i=255}$ | $B_{c,i=255}$ |

FIG. 3A

| Gray | Red | Green | Blue |
|---|---|---|---|
| 0 | $R_{p,i=0}$ | $G_{p,i=0}$ | $B_{p,i=0}$ |
| 1 | $R_{p,i=1}$ | $G_{p,i=1}$ | $B_{p,i=1}$ |
| 2 | $R_{p,i=2}$ | $G_{p,i=2}$ | $B_{p,i=2}$ |
| 3 | $R_{p,i=3}$ | $G_{p,i=3}$ | $B_{p,i=3}$ |
| 4 | $R_{p,i=4}$ | $G_{p,i=4}$ | $B_{p,i=4}$ |
| | | | |
| | | | |
| 253 | $R_{p,i=253}$ | $G_{p,i=253}$ | $B_{p,i=253}$ |
| 254 | $R_{p,i=254}$ | $G_{p,i=254}$ | $B_{p,i=254}$ |
| 255 | $R_{p,i=255}$ | $G_{p,i=255}$ | $B_{p,i=255}$ |

IMAGE PROCESSING DEVICE AND IMAGE PROCESSING METHOD

CROSS-REFERENCE TO RELATED APPLICATION

This application claims priority under 35 U.S.C. § 119 from, and the benefit of, Korean Patent Application No. 10-2015-0091325, filed on Jun. 26, 2015 in the Korean Intellectual Property Office, the contents of which are herein incorporated by reference in their entirety.

BACKGROUND

1. Technical Field

Embodiments of the present disclosure are directed to an image processing device and an image processing method, and, more specifically, to an image processing device and an and image processing method which improve display quality.

2. Discussion of the Related Art

An image processing device includes various image processing circuits which process image data into a form suitable for an image that is displayed on a display panel. Here, the display panel can be a liquid crystal display (LCD) or an organic electroluminescence light emitting display (OLED).

In general, an image processing device includes a data correcting unit which performs a data tuning process such as an accurate color capture (ACC) to maintain color balance. The data correcting unit can tune the data voltage of red, green, and blue surface patterns to maintain a 2.2 gamma curve based on full white color coordinates/color temperatures.

SUMMARY

An image processing device according to an embodiment of the present disclosure comprises: a first look-up table in which first gamma correction values corresponding to a white grayscale are recorded; a second look-up table in which second gamma correction values corresponding to red, green, and blue grayscales are recorded; and a data correcting unit that calculates second image data from received first image data based on a first gamma correction value and a second gamma correction value for the first image data, by referring to the first and second look-up tables.

In an embodiment, the data correcting unit can calculate the second image data using the first gamma correction value for the first image data, when the first image data is a white grayscale, and can calculate the second image data using the second gamma correction value for the first image data, when the first image data is one of a red, green, or blue grayscales.

In an embodiment, the data correcting unit can calculate the second image data by interpolating the first gamma correction value and the second gamma correction value for the first image data when the first image data is a mixed color grayscale.

In an embodiment, the data correcting unit interpolates the first gamma correction value and the second gamma correction value by interpolating the first gamma correction value for red subpixel data of the first image data and the second gamma correction value for red subpixel data of the first image data to calculate red subpixel data of the second image data, by interpolating the first gamma correction value for green subpixel data of the first image data and the second gamma correction value for green subpixel data of the first image data to calculate green subpixel data of the second image data, and by interpolating the first gamma correction value for blue subpixel data of the first image data and the second gamma correction value for blue subpixel data of the first image data to calculate blue subpixel data of the second image data.

In an embodiment, the second image data can be calculated by linear interpolation. In an embodiment, colored subpixel data of the second image data can be calculated by a following mathematical expression:

$$r' = f(r, g, b, R_{c,i=r}, R_{p,i=r}) = \alpha_R \cdot X_R(r, g, b) + \beta_R$$

$$X_R(r, g, b) \equiv \frac{1}{4}[(2r - g - b) + |2r - g - b|], (0 \le X_R \le r)$$

$$\alpha_R = \frac{R_{p,i=r} - R_{c,i=r}}{r}, \beta_R = R_{c,i=r},$$

wherein r' is colored subpixel data of the second image data, (r, g, b) is red, green, and blue subpixel data of the first image data, Rc,i=r is the first gamma correction value for the colored subpixel data r of the first image data, and Rp,i=r is the second gamma correction value for the color subpixel data r of the first image data, wherein colored is one of red, green, or blue.

In an embodiment, the second image data is calculated by a nonlinear interpolation proportional to a power N, wherein N≠1. In an embodiment, colored subpixel data of the second image data can be calculated using a following mathematical expression:

$$r' = f(r, g, b, R_{c,i=r}, R_{p,i=r}) = \alpha_R \cdot X_R(r, g, b)^N + \beta_R$$

$$X_R(r, g, b) \equiv \frac{1}{4}[(2r - g - b) + |2r - g - b|], (0 \le X_R \le r)$$

$$\alpha_R = \frac{R_{p,i=r} - R_{c,i=r}}{r}, \beta_R = R_{c,i=r},$$

wherein r' is a colored red subpixel data of the second image data, (r, g, b) is red, green, and blue subpixel data of the first image data, Rc,i=r is the first gamma correction value for the colored subpixel data r of the first image data, and Rp,i=r is the second gamma correction value for the colored subpixel data r of the first image data, wherein colored is one of red, green, or blue.

In an embodiment, the power N can be determined by how much weight is to be applied to the first gamma correction value or the second gamma correction value.

In an embodiment, the first and second image data can each include red, green, and blue subpixel data, respectively. In an embodiment, the first and second gamma correction values can be respectively defined as a relative level of a voltage or a current corresponding to grayscale values of the red, green, and blue subpixel data. In an embodiment, a reference gamma value can be 2.2.

In an embodiment, the image processing device can further include: a display unit that includes a plurality of pixels connected to gate lines and data lines; a gate driving unit which outputs a gate signal to the gate lines; a data driving unit which outputs a data signal to the data lines; and a timing control unit which controls the gate driving unit and the data driving unit based on the first image data and a clock signal. In an embodiment, the data correcting unit is integrated with the timing control unit.

A method of processing an image according to an embodiment of the present disclosure comprises: generating a first look-up table in which first gamma correction values for a white grayscale are recorded; generating a second look-up table in which second gamma correction values for red, green, and blue grayscales are recorded; and calculating second image data from received first image data based on a first gamma correction value and a second gamma correction value for the first image data, by referring to the first and second look-up tables.

In an embodiment, calculating the second image data includes using the first gamma correction value for the first image data when the first image data is a white grayscale, and using the second gamma correction value for the first image data when the first image data is one of the red, green, and blue grayscales.

In an embodiment, calculating the second image data includes interpolating the first gamma correction value and the second gamma correction value for the first image data when the first image data is a mixed color grayscale.

A method of processing an image according to an embodiment of the present disclosure comprises: receiving first image data; and calculating second image data from the first image data using a first gamma correction value for the first image data, when the first image data is a white grayscale, using a second gamma correction value for the first image data when the first image data is one of a red, green, or blue grayscale, and interpolating the first gamma correction value and the second gamma correction value for the first image data when the first image data is a mixed color grayscale.

In an embodiment, the method may include recording the first gamma correction values for the white grayscale in a first look-up table; recording the second gamma correction values for the red, green, and blue grayscales in a second look-up table; and referring to the first and second look-up tables to calculate the second image data.

In an embodiment, interpolating the first gamma correction value and the second gamma correction value may include interpolating the first gamma correction value for red subpixel data of the first image data and the second gamma correction value for red subpixel data of the first image data to calculate red subpixel data of the second image data, interpolating the first gamma correction value for green subpixel data of the first image data and the second gamma correction value for green subpixel data of the first image data to calculate green subpixel data of the second image data, and interpolating the first gamma correction value for blue subpixel data of the first image data and the second gamma correction value for blue subpixel data of the first image data to calculate blue subpixel data of the second image data.

By correcting image data using first gamma correction values for the white grayscales and the second gamma correction values for the red, green or blue grayscales, deviations in color coordinates can be reduced and image quality can be improved.

BRIEF DESCRIPTION OF THE DRAWINGS

FIG. 2A is illustrates a first look-up table.

FIG. 3A illustrates a second look-up table.

DETAILED DESCRIPTION OF THE DISCLOSURE

Figure 1A:
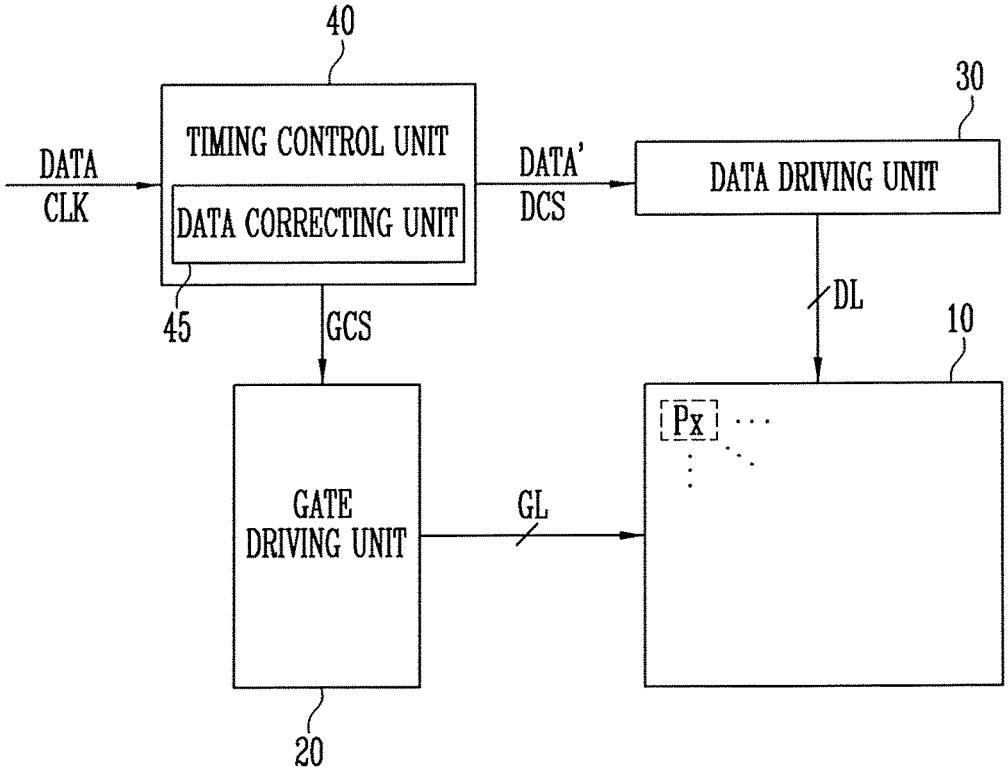
FIG. 1A shows a schematic configuration of an image processing device according to an embodiment of the present disclosure.

Exemplary embodiments will now be described more fully hereinafter with reference to the accompanying drawings; however, they may be embodied in different forms and should not be construed as limited to the embodiments set forth herein.

In the drawing figures, dimensions may be exaggerated for clarity of illustration. It will be understood that when an element is referred to as being "between" two elements, it can be the only element between the two elements, or one or more intervening elements may also be present. Like reference numerals may refer to like elements throughout.

Figure 1B:
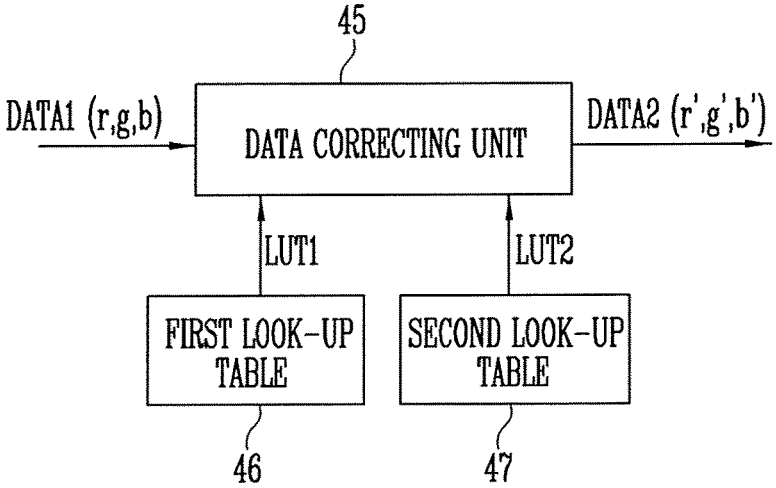
FIG. 1B is a detailed configuration of a data correcting unit shown in FIG. 1B.

FIG. 1A shows a schematic configuration of an image processing device according to an embodiment of the present disclosure and FIG. 1B is a detailed configuration of a data correcting unit shown in FIG. 1B.

Referring to FIG. 1A, an image processing device according to an embodiment of the present disclosure comprises a display unit 10, a gate driving unit 20, a data driving unit 30, and a timing control unit 40.

The display unit 10 includes a plurality of pixels PX which are connected to gate lines GL and data lines DL and arranged in a matrix formation. The pixels PX receive gate signals from the gate lines GL and receive data signals from the data lines DL. The pixels PX emit light at a brightness corresponding to the data signals received from the data lines DL when the gate signals are received from the gate lines GL. The display unit 10 according to an embodiment may be a liquid display panel.

The gate driving unit 20 is connected to the gate lines GL, generates the gate signals in response to a gate control signal GCS received from the timing control unit 40, and outputs the generated gate signal to the gate lines GL. The gate driving unit 20 can be configured as a plurality of stage circuits, and the pixels PX are selected on a horizontal line basis when the gate signals are sequentially supplied to the gate lines GL.

The data driving unit 30 is connected to the data lines DL, generates a data signal based on a data control signal DCS 40 and image data DATA received from the timing control unit and outputs the generated data signal to the data lines DL. The data signal supplied to the data lines DL is then supplied to the pixels PX selected by the gate signal when the gate signal is received. Then, the pixels PX are charged to a voltage which corresponds to the data signal.

The timing control unit 40 receives the image data DATA, a clock signal CLK for controlling the image data to be displayed, etc. The timing control unit 40 processes the received image data DATA to generate corrected image data DATA' which is corrected to be properly displayed on the display unit 10, and outputs the corrected image data DATA' to the data driving unit 30. In addition, the timing control unit 40 generates and outputs driving control signals GCS, DCS to control the gate driving unit 20 and the data driving unit 30 based on the clock signal CLK. More specifically, the timing control unit 40 generates the gate control signal GCS and supplies it to the gate driving unit 20, and generates the data control signal DCS and supplies it to the data driving unit 30.

According to an embodiment, the timing control unit 40 includes a data correcting unit 45 which performs a data tuning process. Referring to FIG. 1B, the data correcting unit 45 stores first gamma correction values LUT1 in the first look-up table 46, and second gamma correction values LUT2 in the second look-up table 47, and refers to these values while converting received first image data DATA1 to second image data DATA2 to be output. Here, the first gamma correction values LUT1 correspond to white grayscales such that a reference gamma value is applied on the basis of white color coordinates, and the second gamma correction values LUT2 correspond to red, green, and blue grayscales such that a reference gamma value is applied on the basis of color coordinates of pure colors corresponding to red, green, and blue grayscales. The data correcting unit 45 calculates the second image data DATA2 based on the first gamma correction values LUT1 and the second gamma correction values LUT2, both of which correspond to the first image data DATA1. The calculation of the second image data DATA2 will be described in detail below.

In addition, although the data correcting unit 45 is disclosed as integrated into the timing control unit 40, embodiments of the present disclosure are not limited to this configuration, and in other embodiments, the data correcting unit 45 can be a separate component apart from the timing control unit 40.

Figure 2B:
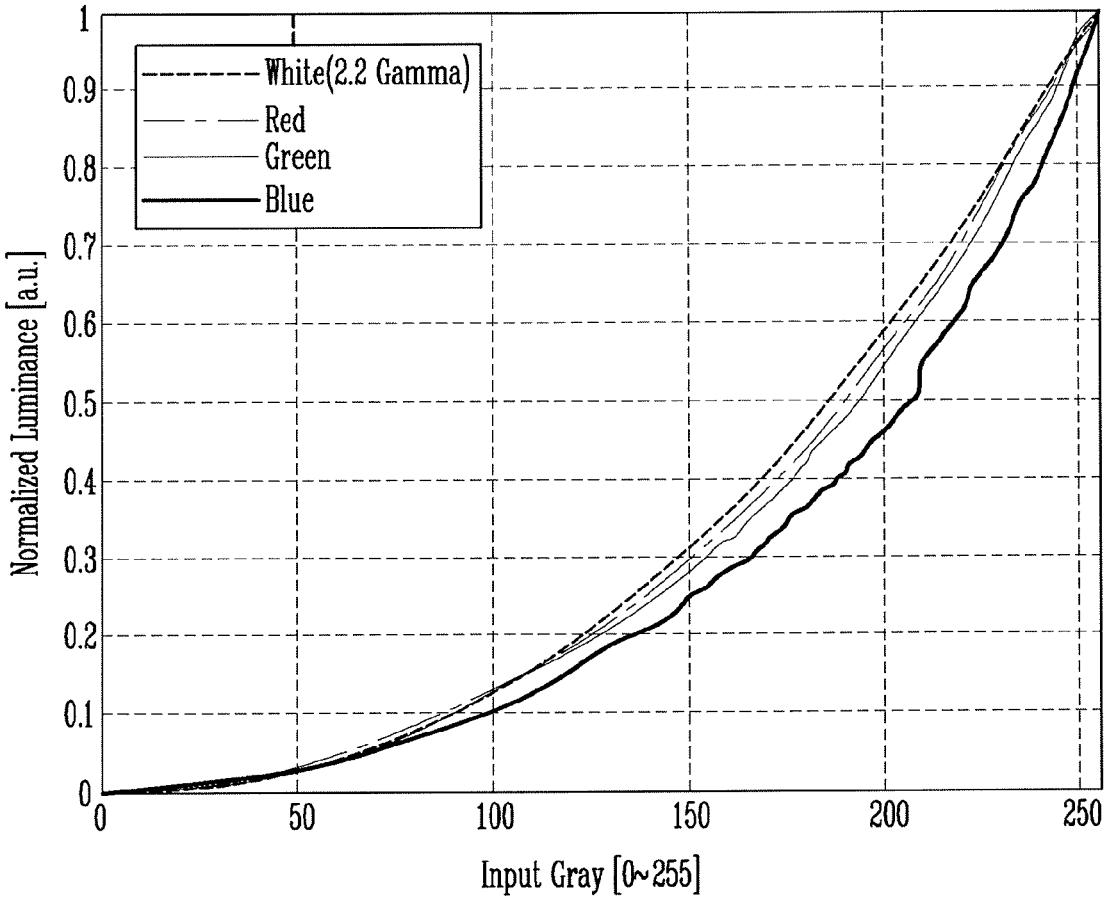
FIG. 2B illustrates a gamma curve of first gamma correction values.

FIG. 2A illustrates a first look-up table, and FIG. 2B illustrates a gamma curve of first gamma correction values.

Referring to FIG. 2A and FIG. 2B, the first gamma correction values LUT1, which correspond to a white grayscale to which the reference gamma value is applied based on the white color coordinates, are recorded in the first look-up table 46. Here, the first and second gamma correction values LUT1 and LUT2 can be defined as a relative level of a voltage or a current that corresponds to grayscale values of the red, green, and blue subpixel data. In addition, the first gamma correction values LUT1 can be determined in a factory mode before release to constitute the first look-up table 46.

In an embodiment, the first gamma correction values LUT1 include red gamma correction values Rc,i, green gamma correction values Gc,i, and blue gamma correction values Bc,i, which correspond to grayscales of 0-255. At first, a red gamma correction value (Rc,i=255), a green gamma correction value (Gc,i=255), and a blue gamma correction value (Bc,i=255), which correspond to a grayscale of 255 of white subpixel data, are determined on the basis of the color coordinates of full white, which is the maximum grayscale. Then, all red, green, and blue gamma correction values Rc,i, Gc,i, and Bc,i are determined to maintain a gamma value of 2.2 in an overall grayscale region of 0 to 255. At this point, although the gamma curve of the white grayscale, which is a combination of the red, green, and blue gamma correction values Rc,i, Gc,i, and Bc,I, maintains the gamma value of 2.2 in the overall grayscale region, the gamma curve of the red grayscale gamma correction values Rc,i, the gamma curve of the green grayscale gamma correction values Gc,i, and the gamma curve of the blue grayscale gamma correction values Bc,i do not coincide with and deviate from each other.

The data correcting unit 45 calculates the second image data DATA2 by selecting the red, green, and blue gamma correction values Rc,i, Gc,i, and Bc,i of the first gamma correction values LUT1 corresponding to the red, green, and blue subpixel data r, g, and b of the first image data DATA1, when the first image data DATA1 is a white grayscale. For example, when the first image data DATA1 is a grayscale of white 120, the input grayscale value is 120, and the red gamma correction value (Rc,i=120), the green gamma correction value (Gc,i=120), and the blue gamma correction value (Bc,i=120), which correspond to the grayscale of 120, are selected from the first gamma correction values LUT1 recorded in the first look-up table 46 to calculate red, green, and blue subpixel data r', g', and b' of the second image data DATA2.

When the first image data DATA1 is a white grayscale, a relationship between the first image data DATA1 and the second image data DATA2 can be summarized as the following mathematical expression.

$$r' = R_{c,i=r}$$

$$g' = G_{c,i=g}$$

$$b' = B_{c,i=b} \tag{1}$$

Here, (r', g', b') are the red, green, and blue subpixel data of the second image data, (r, g, b) are the red, green, and blue subpixel data of the first image data, Rc,i=r is the first gamma correction value for the red subpixel data r of the first image data, Gc,i=g is the first gamma correction value for the green subpixel data g of the first image data, and Bc,i=b is the first gamma correction value for the blue subpixel data b of the first image data. That is, when the first image data DATA1 is a white grayscale, the data correcting unit 45 can calculate the second image data DATA2 by referring only to the first gamma correction value LUT1 recorded in the first look-up table 46.

Figure 3B:
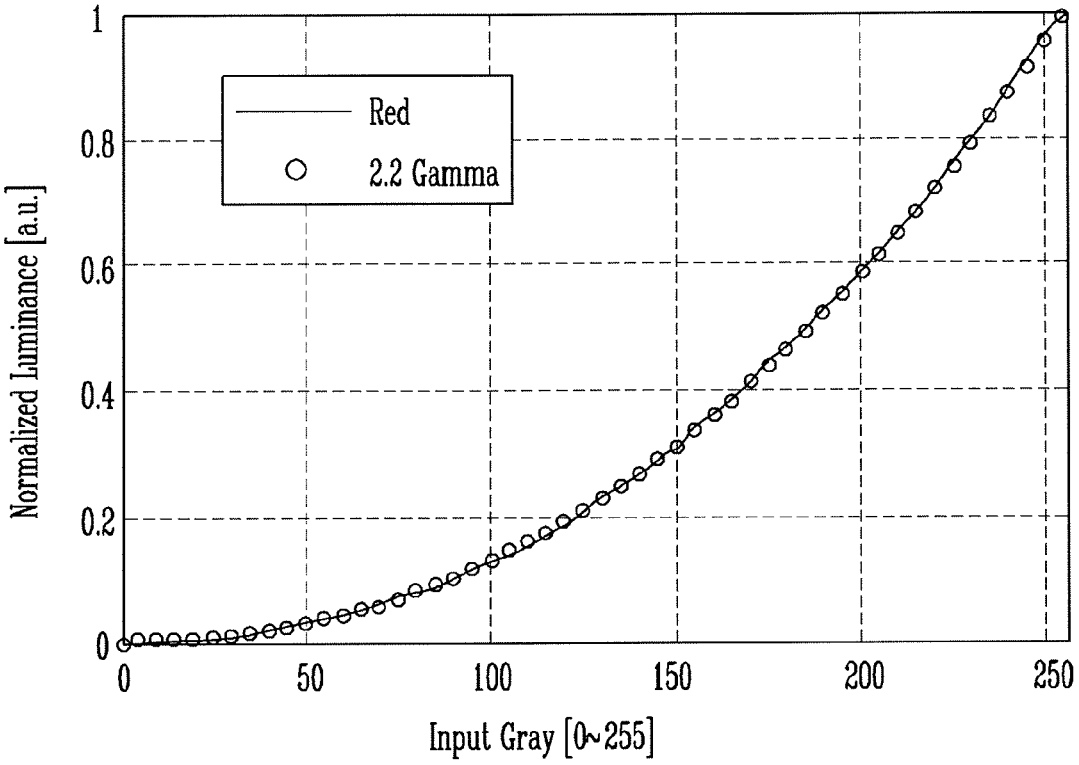
FIG. 3B illustrates a gamma curve of red grayscales of the second gamma correction values.
Figure 3C:
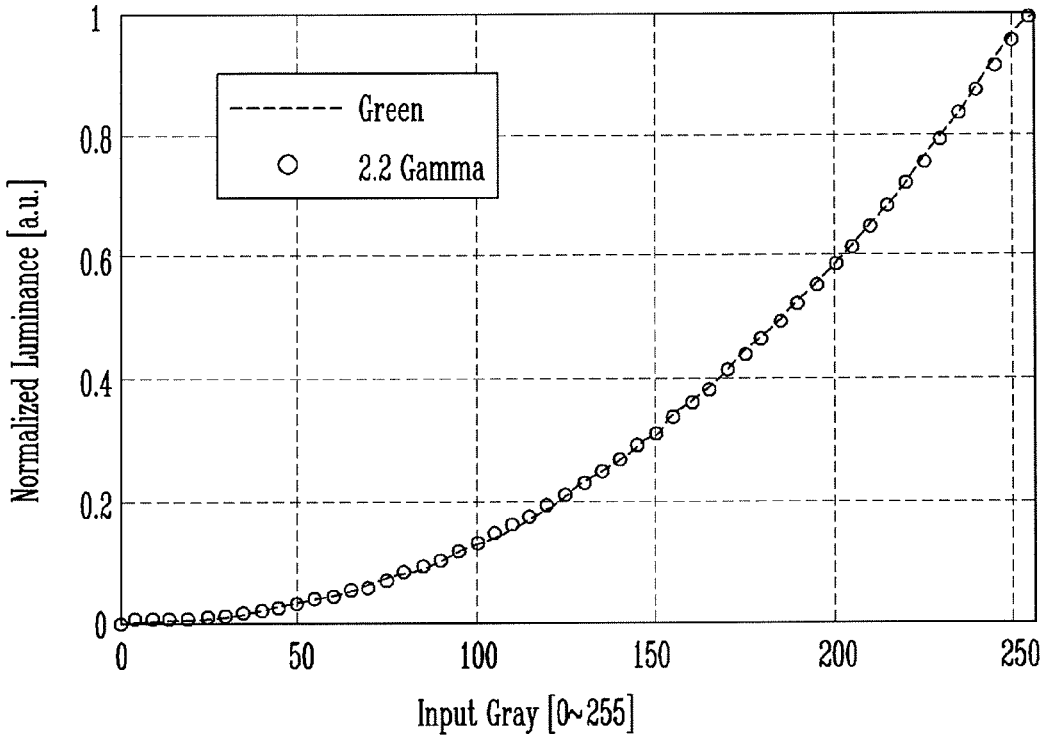
FIG. 3C illustrates a gamma curve of green grayscales of the second gamma correction values.
Figure 3D:
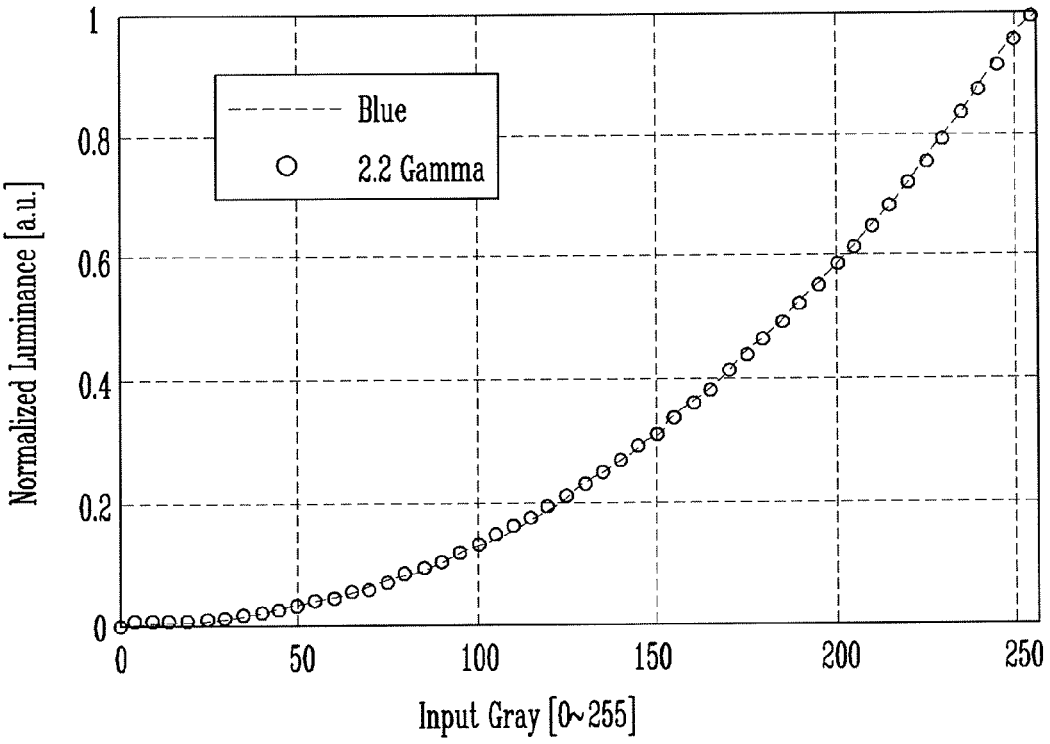
FIG. 3D illustrates a gamma curve of blue grayscales of the second gamma correction values.

FIG. 3A illustrates the second look-up table 47, FIG. 3B illustrates a gamma curve of red grayscales of the second gamma correction values, FIG. 3C illustrates a gamma curve of green grayscales of the second gamma correction values, and FIG. 3D illustrates a gamma curve of blue grayscales of the second gamma correction values.

Referring to FIG. 3A, FIG. 3B, FIG. 3C and FIG. 3D, the second gamma correction values LUT2 for the red, green, and blue grayscales are recorded in the second look-up table 47 such that the reference grayscale is applied based on color coordinates of pure colors corresponding to the red, green, and blue subpixels. Here, the second gamma correction values LUT2 can be defined as a relative level of a voltage or a current that corresponds to grayscale values of the R, G, and B subpixel data. In addition, the second gamma correction value LUT2 can be determined in a factory mode before release to constitute the second look-up table 47.

In an embodiment, the second gamma correction values LUT2 include red gamma correction values Rp,i, green gamma correction values Gp,i, and blue gamma correction values Bp,i, which correspond to grayscales of 0-255. More specifically, the red gamma correction value Rp,i is determined to maintain a gamma value of 2.2 in an overall grayscale region from 0 to 255 based on the red color coordinates. Here, the red color coordinates correspond to a case where the red, green, and blue subpixel data are (r, 0, 0), and are defined as the color coordinates of pure red light when the green and blue subpixels do not emit light. In addition, the G gamma correction value Gp,i is determined to maintain a gamma value of 2.2 in an overall grayscale region from 0 to 255 based on the green color coordinates, and the green color coordinates corresponds to a case when the red, green, and blue subpixel data are (0, g, 0), and are defined as the color coordinates of pure green light when the red and blue subpixels do not emit light. In addition, the blue gamma correction value Bp,i is determined to maintain the gamma value of 2.2 in an overall grayscale region from 0 to 255 based on the blue color coordinates, and the blue color coordinates correspond to a case when the red, green, and blue subpixel data are (0, 0, b), and are defined as the color coordinates of pure blue light when the red and green subpixels do not emit light.

At this point, a gamma curve of the red grayscales represented by red gamma correction value Rp,i that constitute the second gamma correction value LUT2, a gamma curve of the green grayscales represented by green gamma correction value Gp,i, and a gamma curve of the blue grayscales represented by blue gamma correction value Bp,i coincide with one another with substantially no deviation among them, while maintaining a gamma value of 2.2 in the gamma curves.

The data correcting unit 45 calculates the second image data DATA2 by selecting the red, green, and blue gamma correction values Rp,i, Gp,i, and Bp,i of the second gamma correction values LUT2 for to the red, green, and blue subpixel data r, g, and b of the first image data DATA1, when the first image data DATA1 is one of a red, green, or blue grayscale.

For example, if the first image data DATA1 is a grayscale of red 120, the input grayscale value is 120, and the second image data DATA2 has values of (Rp,i=120, 0, 0) and is calculated by selecting the red gamma correction value (Rp,i=120) for the grayscale of 120 from the second gamma correction values LUT2 recorded in the second look-up table 47. If the first image data DATA1 is a grayscale of green 120, the input grayscale value is 120, and the second image data DATA2 has values of (0, Gp,i=120, 0) and is calculated by selecting the green gamma correction value (Gp,i=120) for the grayscale of 120 from the second gamma correction values LUT2 recorded in the second look-up table 47. If the first image data DATA1 is a grayscale of blue 120, the input grayscale value is 120, and the second image data DATA2 has values of (0, 0, Bp,i=120) and is calculated by selecting the blue gamma correction value (Bp,i=120) for the grayscale of 120 from the second gamma correction values LUT2 recorded in the second look-up table 47.

Therefore, when the first image data DATA1 is any one of the red, green, or blue grayscales, the data correcting unit 45 can calculate the second image data DATA2 by referring only to the second gamma correction value LUT2 recorded in the second look-up table 47.

Figure 4A:
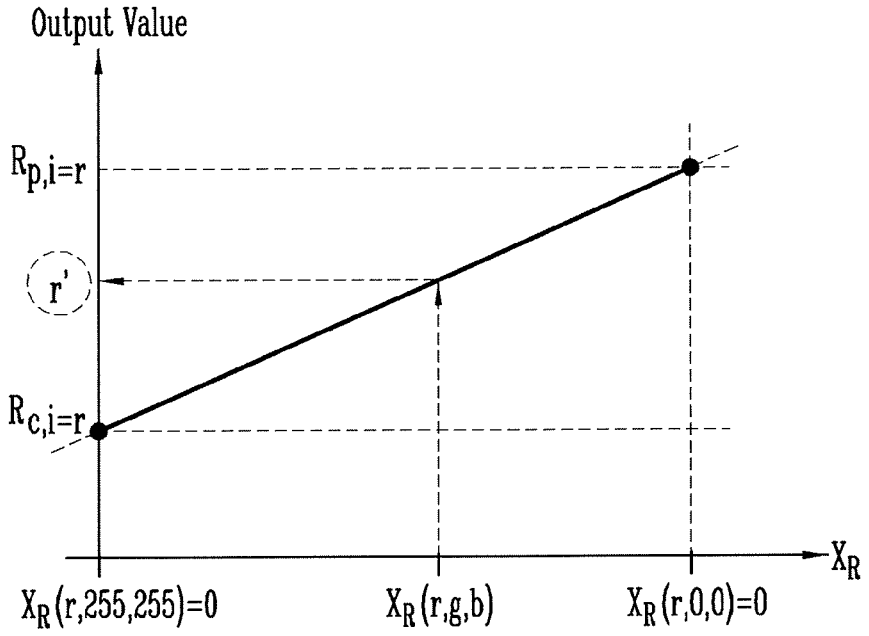
FIG. 4A, FIG. 4B, and FIG. 4C illustrate a method of calculating red, green, and blue subpixel data of a second image data using linear interpolation according to an embodiment of the present disclosure.
Figure 4B:
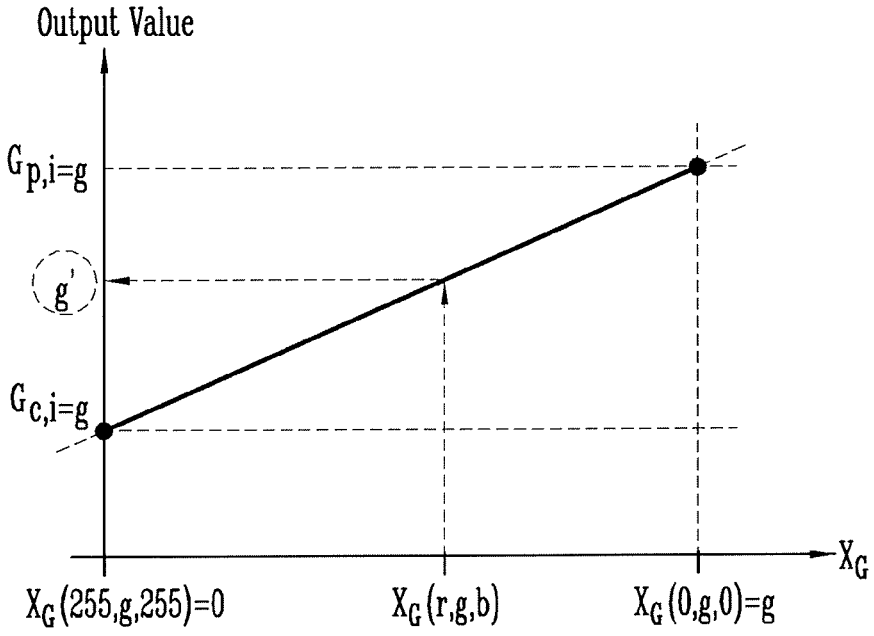
Figure 4C:
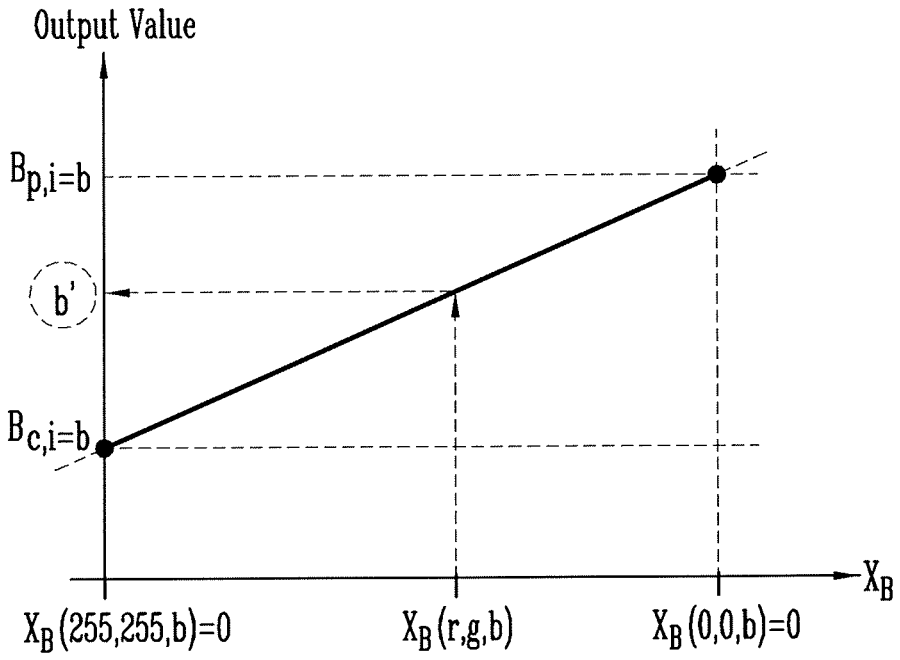

FIG. 4A, FIG. 4B, and FIG. 4C illustrate a method of calculating red, green, and blue subpixel data for the second image data using linear interpolation according to an embodiment of the present disclosure.

Referring to FIG. 4A, FIG. 4B, and FIG. 4C, the data correcting unit 45 calculates the second image data DATA2 by interpolating the first gamma correction value LUT1 and the second gamma correction value LUT2 corresponding to the first image data DATA1, when the first image data DATA1 is a mixed color grayscale.

More specifically, while interpolating the first gamma correction value LUT1 and the second gamma correction value LUT2, the data correcting unit 45 calculates the red subpixel data r' of the second image data DATA2 by interpolating the first gamma correction value (Rc,i=r) and the second gamma correction value (Rp,i=r) for the red subpixel data r of the first image data DATA1. In addition, the data correcting unit 45 calculates the green subpixel data g' of the second image data DATA2 by interpolating the first gamma correction value (Gc,i=g) and the second gamma correction value (Gp,i=g) for the green subpixel data g of the first image data DATA1. In addition, the data correcting unit 45 calculates the blue subpixel data b' of the second image data DATA2 by interpolating the first gamma correction value (Bc,i=b) and the second gamma correction value (Bp,i=b) for the blue subpixel data b of the first image data DATA1.

According to an embodiment, when the first image data DATA1 is a mixed color grayscale, the second image data DATA2 can be calculated using linear interpolation, and red subpixel data r' of the second image data DATA2 can be obtained by using the following mathematical expression.

$$r' = f(r, g, b, R_{c,i=r}, R_{p,i=r}) = \alpha_R \cdot X_R(r, g, b) + \beta_R \tag{2}$$

$$X_R(r, g, b) \equiv \frac{1}{4}[(2r - g - b) + |2r - g - b|], (0 \le X_R \le r)$$

$$\alpha_R = \frac{R_{p,i=r} - R_{c,i=r}}{r}, \beta_R = R_{c,i=r}$$

Here, r' is the red subpixel data of the second image data, (r, g, b) is the red, green, and blue subpixel data of the first image data, Rc,i=r is the first gamma correction value for the red subpixel data of the first image data, and Rp,i=r is the second gamma correction value for the red subpixel data r of the first image data.

In addition, by adopting the same linear interpolation as above, the green subpixel data g' of the second image data DATA2 can be obtained using the following mathematical expression, and the blue subpixel data b' can be obtained by using the subsequent mathematical expression.

$$g' = f(r, g, b, G_{c,i=g}, G_{p,i=g}) = \alpha_G \cdot X_G(r, g, b) + \beta_G \tag{3}$$

$$X_G(r, g, b) \equiv \frac{1}{4}[(2r - g - b) + |2r - g - b|], (0 \le X_G \le g)$$

$$\alpha_G = \frac{G_{p,i=g} - G_{c,i=g}}{r}, \beta_G = G_{c,i=g}$$

$$b' = f(r, g, b, B_{c,i=b}, B_{p,i=b}) = \alpha_B \cdot X_B(r, g, b) + \beta_B \tag{4}$$

$$X_B(r, g, b) \equiv \frac{1}{4}[(2r - g - b) + |2r - g - b|], (0 \le X_B \le b)$$

$$\alpha_B = \frac{B_{p,i=b} - B_{c,i=b}}{b}, \beta_B = B_{c,i=b}$$

Here, Gc,i=g is the first gamma correction value for the green subpixel data g of the first image data, Gp,i=g is the second gamma correction value for the green subpixel data g of the first image data, Bc,i=b is the first gamma correction value for the blue subpixel data b of the first image data, and Bp,i=b is the second gamma correction value for the blue subpixel data b of the first image data.

Figure 5A:
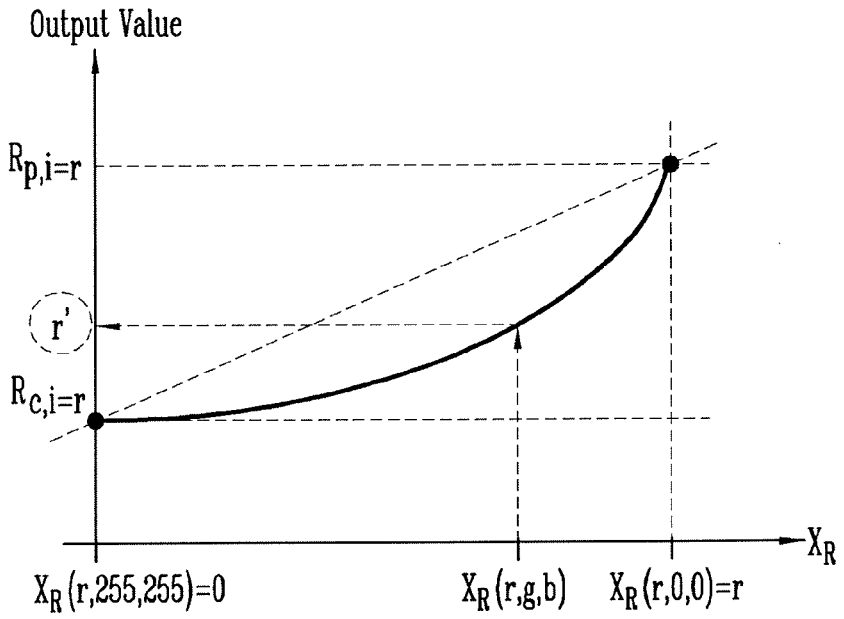
FIG. 5A, FIG. 5B, and FIG. 5C illustrate a method of calculating red, green, and blue subpixel data of a second image data using nonlinear interpolation according to an embodiment of the present disclosure.
Figure 5B:
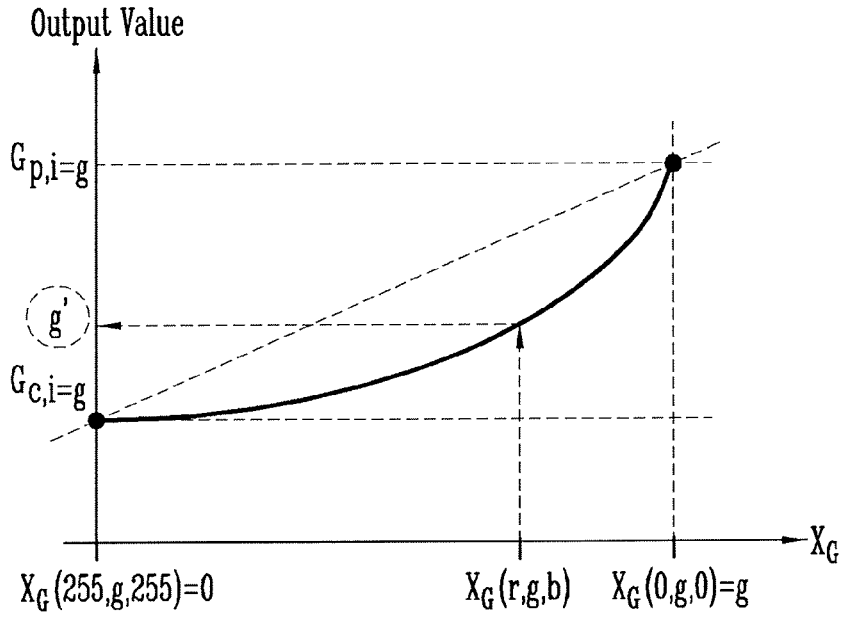
Figure 5C:
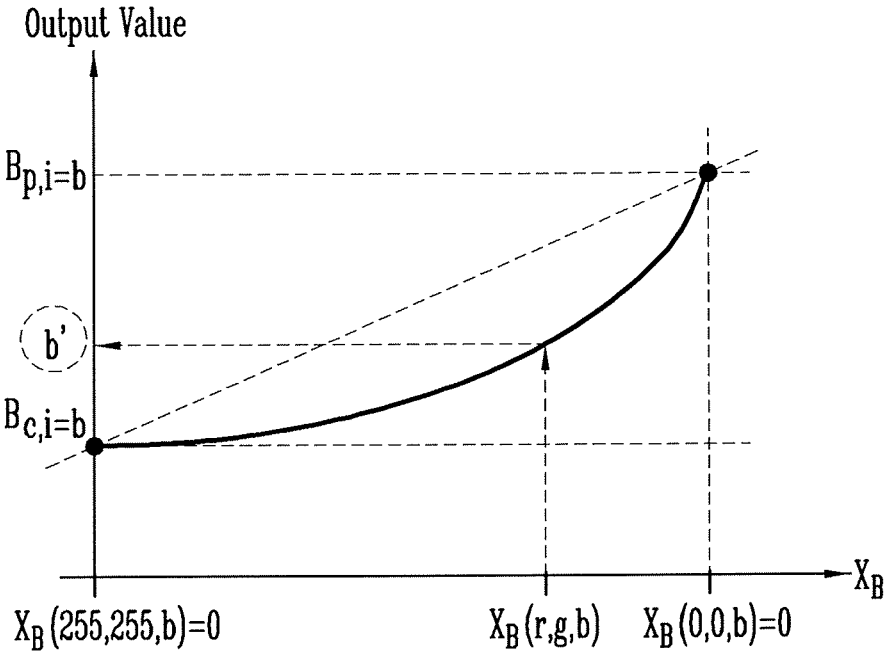

FIG. 5A, FIG. 5B, and FIG. 5C illustrate a method of calculating red, green, and blue subpixel data of the second image data using nonlinear interpolation according to an embodiment of the present disclosure.

Referring to FIG. 5A, FIG. 5B, and FIG. 5C, the data correcting unit 45 calculates the second image data DATA2 by interpolating the first gamma correction value LUT1 and the second gamma correction value LUT2 for the first image data DATA1 when the first image data DATA1 is a mixed color grayscale.

According to an embodiment, when the first image data DATA1 is a mixed color grayscale, the second image data DATA2 can be calculated using nonlinear interpolation proportional to a power N, where N≠1 and the red subpixel data r' of the second image data DATA2 can be obtained using the following mathematical expression.

$$r' = f(r, g, b, R_{c,i=r}, R_{p,i=r}) = \alpha_R \cdot X_R(r, g, b)^N + \beta_R \quad (5)$$

$$X_R(r, g, b) \equiv \frac{1}{4}[(2r - g - b) + |2r - g - b|], (0 \le X_R \le r)$$

$$\alpha_R = \frac{R_{p,i=r} - R_{c,i=r}}{r}, \beta_R = R_{c,i=r}$$

Here, r' is the red subpixel data of the second image data, (r, g, b) is the red, green, and blue subpixel data of the first image data, is the first gamma correction value for the red subpixel data of the first image data, and Rp,i=r is the second gamma correction value for the red subpixel data r of the first image data. The power N in Eqs. (5) can be determined by how much weight is to be applied to the first gamma correction value LUT1 or the second gamma correction value LUT2.

In addition, by adopting the same nonlinear interpolation as above, the green subpixel data g' of the second image data DATA2 can be obtained using the following mathematical expression, and the blue subpixel data b' can be obtained by using the subsequent mathematical expression.

$$g' = f(r, g, b, G_{c,i=g}, G_{p,i=g}) = \alpha_G \cdot X_G(r, g, b)^N + \beta_G \quad (6)$$

$$X_G(r, g, b) \equiv \frac{1}{4}[(2r - g - b) + |2r - g - b|], (0 \le X_G \le g)$$

$$\alpha_G = \frac{G_{p,i=g} - G_{c,i=g}}{r}, \beta_G = G_{c,i=g}$$

$$b' = f(r, g, b, B_{c,i=b}, B_{p,i=b}) = \alpha_B \cdot X_B(r, g, b)^N + \beta_B \quad (7)$$

$$X_B(r, g, b) \equiv \frac{1}{4}[(2r - g - b) + |2r - g - b|], (0 \le X_B \le b)$$

$$\alpha_B = \frac{B_{p,i=b} - B_{c,i=b}}{b}, \beta_B = B_{c,i=b}$$

Here, Gc,i=g is the first gamma correction value for the green subpixel data g of the first image data, Gp,i=g is the second gamma correction value for the green subpixel data g of the first image data, Bc,i=b is the first gamma correction value for the blue subpixel data b of the first image data, and Bp,i=b is the second gamma correction value for the blue subpixel data b of the first image data.

In summary, since conventional image processing devices tune the data voltage based on full white color coordinates/color temperatures, the color coordinates of each of the red, green, and blue subpixels may not coincide at grayscales other than a maximum grayscale representing full white, and the deviation can be large for low grayscales. According to embodiments of the present disclosure, by correcting the image data using first gamma correction values for the white grayscales and second gamma correction values for the red, green, and blue grayscales, deviations in color coordinates can be reduced and image quality can be improved.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of embodiments of the present disclosure as set forth in the following claims.

What is claimed is:

1. An image processing device comprising:

a first look-up table in which first gamma correction values for a white grayscale are recorded;

a second look-up table in which second gamma correction values corresponding to red, green, and blue grayscales are recorded; and a data correcting unit that calculates second image data from received first image data based on a first gamma correction value and a second gamma correction value for the first image data by referring to the first and second look-up tables, wherein the data correcting unit calculates the second image data by using only the first gamma correction value for the first image data, when the first image data is a white grayscale, calculates the second image data by using only the second gamma correction value for the first image data, when the first image data is one of a pure red, pure green, or pure blue grayscale, and calculates the second image data by interpolating the first gamma correction value and the second gamma correction value for the first image data when the first image data is mixed color grayscale, wherein interpolating the first gamma correction value and the second gamma correction value includes interpolating the first gamma correction value for red subpixel data of the first image data and the second gamma correction value for red subpixel data of the first image data to calculate red subpixel data of the second image data, interpolating the first gamma correction value for green subpixel data of the first image data and the second gamma correction value for green subpixel data of the first image data to calculate green subpixel data of the second image data, and interpolating the first gamma correction value for blue subpixel data of the first image data and the second gamma correction value for blue subpixel data of the first image data to calculate blue subpixel data of the second image data.

2. The image processing device of claim 1, wherein the second image data is calculated by linear interpolation.

3. The image processing device of claim 2, wherein colored subpixel data of the second image data is calculated using a following mathematical expression:

$$r' = f(r, g, b, R_{c,i=r}, R_{p,i=r}) = \alpha_R \cdot X_R(r, g, b) + \beta_R$$

$$X_R(r, g, b) \equiv \frac{1}{4}[(2r - g - b) + |2r - g - b|], (0 \le X_R \le r)$$

$$\alpha_R = \frac{R_{p,i=r} - R_{c,i=r}}{r}, \beta_R = R_{c,i=r}$$

wherein r' is colored subpixel data of the second image data, (r, g, b) is red, green, and blue subpixel data of the first image data, Rc,i=r is the first gamma correction value for the colored subpixel data r of the first image data, and Rp,i=r is the second gamma correction value for the color subpixel data r of the first image data, wherein colored is one of red, green, or blue.

4. The image processing device of claim 1, wherein the second image data is calculated using a nonlinear interpolation proportional to a power N, wherein N≠1.

5. The image processing device of claim 4, wherein colored subpixel data of the second image data is calculated using a following mathematical expression:

$$r' = f(r, g, b, R_{c,i=r}, R_{p,i=r}) = \alpha_R \cdot X_R(r, g, b)^N + \beta_R$$

$$X_R(r, g, b) \equiv \frac{1}{4}[(2r - g - b) + |2r - g - b|], (0 \le X_R \le r)$$

$$\alpha_R = \frac{R_{p,i=r} - R_{c,i=r}}{r}, \beta_R = R_{c,i=r}$$

wherein r' is a colored red subpixel data of the second image data, (r, g, b) is red, green, and blue subpixel data of the first image data, Rc,i=r is the first gamma correction value for the colored subpixel data r of the first image data, and Rp,i=r is the second gamma correction value for the colored subpixel data r of the first image data, wherein colored is one of red, green, or blue.

6. The image processing device of claim 4, wherein the power N is determined by how much weight is to be applied to the first gamma correction value or the second gamma correction value.

7. The image processing device of claim 1, wherein the first and second image data each include red, green, and blue subpixel data, respectively.

8. The image processing device of claim 1, wherein the first and second gamma correction values are respectively defined as a relative level of a voltage or a current corresponding to grayscale values of the red, green, and blue subpixel data.

9. The image processing device of claim 1, characterized in that a reference gamma value is 2.2.

10. The image processing device of claim 1, further comprising:

a display unit that includes a plurality of pixels connected to gate lines and data lines;

a gate driving unit which outputs a gate signal to the gate lines;

a data driving unit which outputs a data signal to the data lines; and a timing control unit which controls the gate driving unit and the data driving unit based on the first image data and a clock signal.

11. The image processing device of claim 10, wherein the data correcting unit is integrated with the timing control unit.

12. A method of processing an image, comprising the steps of:

generating a first look-up table in which first gamma correction values for a white grayscale are recorded;

generating a second look-up table in which second gamma correction values for red, green, and blue grayscales are recorded; and calculating second image data from received first image date based on a first gamma correction value and a second gamma correction value for the first image data, by referring to the first and second look-up tables, wherein the calculating the second image data comprises using only the first gamma correction value for the first image data, when the first image data is a white grayscale, using only the second gamma correction value for the first image data, when the first image data is one of a pure red, pure green, or pure blue grayscale, and interpolating the first gamma correction value and the second gamma correction value for the first image data when the first image data is a mixed color grayscale, wherein interpolating the first gamma correction value and the second gamma correction value includes interpolating the first gamma correction value for red subpixel data of the first image data and second gamma correction value for red subpixel data of the first image data to calculate red subpixel data of the second image data, interpolating the first gamma correction value for green subpixel data of the first image data and the second gamma correction value for green subpixel data of the first image data to calculate green subpixel data of the second image data, and interpolating the first gamma correction value for blue subpixel data of the first image data and the second gamma correction value for blue subpixel data of the first image data to calculate blue subpixel data of the second image data.

13. The image processing method of claim 12, wherein calculating the second image data comprises interpolating the first gamma correction value and the second gamma correction value for the first image data when the first image data is mixed color grayscale.

14. A method of processing an image, comprising the steps of:

receiving first image data; and calculating second image data from the first image data using only a first gamma correction value for the first image data when the first image data is a white grayscale, using only a second gamma correction value for the first image data when the first image data is one of a pure red, pure green, or pure blue grayscale, and interpolating the first gamma correction value and the second gamma correction value for the first image data when the first image data is a mixed color grayscale, wherein interpolating the first gamma correction value and the second gamma correction value comprises:

interpolating the first gamma correction value for red subpixel data of the first image data and the second gamma correction value for red subpixel data of the first image data to calculate red ssubpixel data of the second image data, interpolating the first gamma correction value for green subpixel data of the first image data and the second gamma correction value for green subpixel data of the first image data to calculate green subpixel data of the second image data, and interpolating the first gamma correction value for blue subpixel data of the first image data and the second gamma correction value for blue subpixel data of the first image data to calculate blue subpixel data of the second image data.

15. The method of claim 14, further comprising:

recording first gamma correction values for the white grayscale in a first look-up table;

recording second gamma correction values for the pure red, pure green, and pure blue grayscales in a second look-up table; and referring to the first and second look-up tables to calculate the second image data.

* * * * *